United States Patent [19]

Loomis, III

[11] 4,405,927

[45] Sep. 20, 1983

[54] PHASE SHIFTER START/STOP ELECTRONIC TRIMMING

[75] Inventor: Jester M. Loomis, III, Huntsville, Ala.

[73] Assignee: The United States of America as represented by the Secretary of the Army, Washington, D.C.

[21] Appl. No.: 266,771

[22] Filed: May 26, 1981

[51] Int. Cl.[3] ..... H01Q 3/38

[52] U.S. Cl. ..... 343/854; 307/412; 333/24.1

[58] Field of Search ..... 343/854; 333/24.1; 328/155; 307/412

[56] References Cited

U.S. PATENT DOCUMENTS 4,042,831 8/1977 Lenhoff ..... 333/24.1

*Primary Examiner*—Eli Lieberman

*Attorney, Agent, or Firm*—Robert P. Gibson; Anthony T. Lane; Freddie M. Bush

[57] ABSTRACT

The phase shifter start/stop electronic trimming circuit provides a means for electronically trimming phase shifters when stop/start two axis steering is used. A time delay is incorporated into the start logic line of each phase shifter driver allowing the particular insertion phase characteristic of the microwave portion of the phase shifter to be accounted for. Variations of 360 degrees of insertion phase can be trimmed by this method. Delaying the start pulse into the logic device makes the phase setting less than that required of a perfect phase shifter, thereby correcting all units whose insertion phase is longer than the perfect unit. Consequently, the nominal insertion phase of a perfect unit will normally be the shortest phase length encountered. Where a shorter than nominal insertion phase is involved, the insertion phase difference may be subtracted from 360° and using the value.

4 Claims, 8 Drawing Figures

PHASE SHIFTER START/STOP ELECTRONIC TRIMMING

DEDICATORY CLAUSE

The invention described herein may be manufactured, used, and licensed by or for the Government for governmental purposes without the payment to me of any royalties thereon.

PRIOR ART STATEMENT

No relevant prior art has been considered in the preparation of this application.

BACKGROUND OF THE INVENTION

A phased array antenna is capable of forming a beam in different directions without moving the antenna mechanically. The beam is electronically steered or moved by changing the relative phase between each element in a prescribed manner, through a device called a phase shifter or phasor. The phase shifter is usually composed of three sections as shown typically in FIG. 1. As shown in FIG. 1, a microwave section 10 is, typically, a waveguide housing that is ferrite toroid controlled or a stripline or microstrip that is diode controlled. This section changes the radio frequency phase through interaction with the electromagnetic fields. The driver 12 provides the electronic signals necessary to regulate the phase shift within microwave section 10. Driver 12 is shown as a Darlington transistor circuit and is typical of the high current circuit used to provide drive current to a ferrite toroid. The logic section 14 functions as the interface between the phased array controller and each individual phase shifter. In the logic section 14 the computer logic level commands from the controller are changed into trimming signals for the driver to use.

In a phase shifter the material characteristics, part types, and dimensions all play an important role in controlling of phase shift. Since phase accuracy directly affects not only beam pointing accuracy, but also the antenna gain and sidelobe levels, it is very important that phase shifters be controllable, reproducible devices.

The antenna designer is permitted two options in the control of the phase shift. The first option is to control all the parameters of the microwave section very carefully and thus produce very uniform parts. The other alternative is to build a less controlled part, measure its input/output characteristics and compensate for any errors. The compensation or trimming can be performed in either the microwave section 10 or in the driver section 12. Microwave trimming can be performed by varying the amount of phase shifting material used or by introducing new material into the device. Driver or electronic trimming takes the phase shift command and modifies it to account for the variability in the microwave section. One method being used for electronic trimming is to store a digital word in the beam steering computer memory and adjust the commands before they are sent to the phase shifter. Another electronic trimming technique involves storing a digital word on board the driver and adding this word to the command within the driver logic. These techniques have been used with digital control lines to the phase shifter and require a command line to each individual phasor.

An alternative method to command an array is to use row and column steering. Rather than having an individual command line to each phase shifter, row and column steering has a single command line for each row and each column of the array lattice. Such a scheme provides economics in that the number of command lines is reduced from $N^2$ to 2 N for a square array with N elements on a side. Since the phase shift requirements to steer beams are linear, row and column steering performs the commanding function ideally. In addition, a technique has been developed whereby the phase shift command is the combination of a start pulse sent on either the row or column line, which turns the driver on, followed at an appropriate time by a stop command on the other axis line, whereby the driver is turned off. This method is shown typically in FIG. 2 for a 9 element array ($3\times3$). Each element receives a command for the row line and the column line. The actual phase command to each element is the sum of the phase command on the row line plus the phase command on the column line. As an example, assuming, the column line starts or turns on the driver and the row line turns off or stops the driver current, a pulse on C1 would start current flowing into the phasor of element 1 and a pulse on R1 would stop the current flow. These pulse commands are shown in FIG. 3(*a*). FIG. 3(*b*) shows a typical command given to element 2 during the same cycle. The command occurs at the same time at both elements 1 and 2; however, element 2 is started by a different column command (C2) that occurs later than the column command to element 1 (C1). Thus the current to element 2 is on for a shorter time than the current to element 1. Since the amount of phase shift ($\phi$) is directly proportional to current (I) and time (t), $$\phi \alpha It, \tag{1}$$

the phase of element 1 is longer than that of element 2.

The phase settings at each phase shifter need only be between 0° and 360° because the sinusoidal wave transmitted or received by the array repeats every 360 electrical degrees. Consequently it is only necessary to build a device that is capable of shifting 360° in the maximum time between stop and start commands.

Additional prior art background respecting phased array antennas and beam steering control is set forth in technical publications such as the "Radar Handbook" by M. I. Skolnik, published by McGraw-Hill, Book Co., 1970, Chapter 12. Pages 193–197 of the "Handbook of Radar Measurement", by D. K. Barton and H. R. Ward, Prentice-Hall, Inc., Englewood Cliffs, N. V., 1969, are also descriptive.

SUMMARY OF THE INVENTION

The phase shifter electronic trimming provides a circuit and method to electronically trim phase shifters when start/stop two axis steering is used. A time delay network is incorporated into the start logic line of the phase shifter so that the particular insertion phase characteristic of the microwave portion of the phase shifter can be accounted for. Delaying the start pulse into the logic device makes the phase setting smaller than required of a perfect phase shifter, thereby correcting all units when insertion phase is longer than the perfect unit. Variations of 360 degrees of insertion phase can be trimmed in this way.

DESCRIPTION OF THE PREFERRED EMBODIMENT

The phase shifter electronic trimming circuit provides a method to electronically trim phase shifters when start/stop two-axis steering commands are used. A time delay circuit is added into the start logic circuit of the phase shifter so that the insertion phase variations of the phasor can be accounted for.

The total phase change that the signal undergoes when it passes through a phase shifter can be broken into two components, which are identified here as insertion phase and differential phase. In equation form the insertion phase, $\phi_i$, can be summed with the differential phase, $\phi_d$, to yield the total phase, $\phi_t$, or $$\phi_t=\phi_i+\phi_d \tag{2}$$

The insertion phase is considered as inherent through phase of the phase shifter, whereas the differential phase is the phase setting created by the row and column command lines. In array operation, the total phase variation among the elements creates beam movement. A constant reference phase at each element will not move the beam. Therefore, if the insertion phase can be made a constant, k, then the total phase variation, $\Delta\phi$, will depend only on the differential phase between elements. That is $$\phi_t=\phi_d+k, \text{ and} \tag{3}$$

$$\Delta\phi_t=\phi_d. \tag{4}$$

However, it is difficult to make the insertion phase a constant because very tight controls on the construction material characteristics are necessary, dimensional tolerances must be kept small, and uniform production techniques must be maintained.

The insertion phase can be made to vary by adjusting for this variation in the differential phase term. If insertion phase variation is denoted by $\epsilon_I$, then the total phase can be written as $$\phi_t=\phi_d+k+\epsilon_I \tag{5}$$

where k is the same reference phase constant of the uniform phase shifters of Equation (3). The phase variation is then $$\Delta\phi_t=\phi_d+\epsilon_I. \tag{6}$$

This phase variation is in error by the $\epsilon_I$ term; therefore, in order to make $\Delta\phi_t$ equal to $\phi_d$ it is necessary to subtract from the differential phase command a phase term $$\theta=\epsilon_I \tag{7}$$

so that $$\Delta\phi_t=(\phi_d+\epsilon_I)-\theta \tag{8}$$

or rearranging the equation $$\Delta\phi_t=(\phi_d-\theta)+\epsilon_I \tag{9}$$

where the parenthetical expression, $(\phi_d-\theta)$, represents the actual time the driver is turned on and $\epsilon_I$ is the residual phase shift left in the element. Therefore, for example, assuming that a particular phase shifter has an insertion phase error, $\epsilon_I$, equal to 50° then if the desired phase variation, $\Delta\phi_t$, is 95° the command to the driver should be $$\phi_c=(\phi_d-\theta)=95°-50°=45°.$$

The resulting phase variation is simply the sum of the commanded phase and the insertion phase error or $$\Delta\phi_t=\phi_c+\epsilon_I$$

$$\Delta\phi_t=45°+50°=95°$$

which is the desired response.

Figure 1:
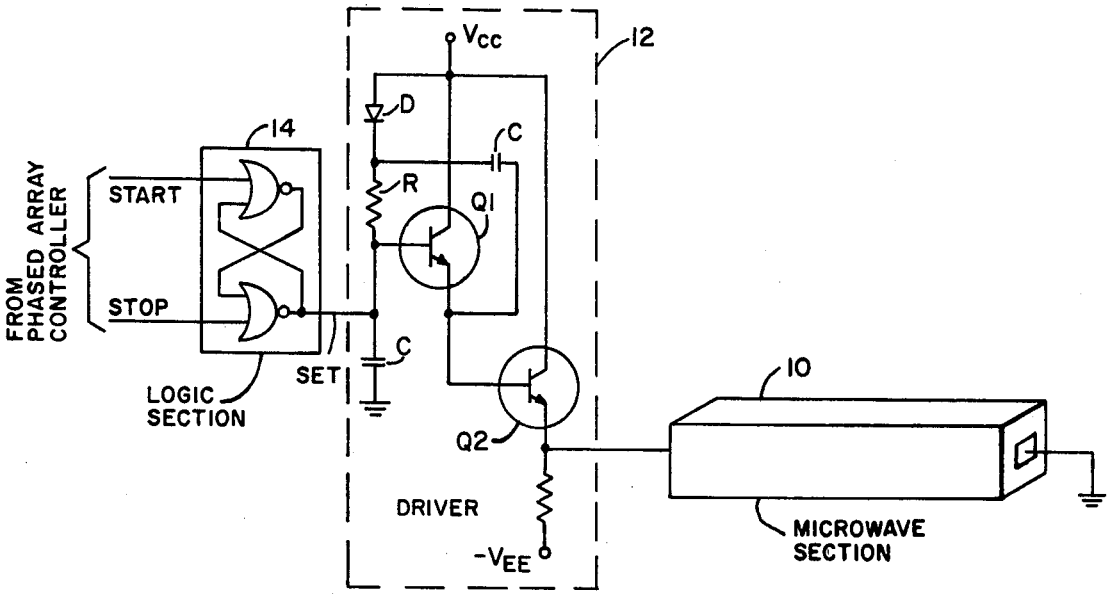
FIG. 1 (PRIOR ART)
FIG. 1 is a diagram of a typical prior art phase shifter.
Figure 2:
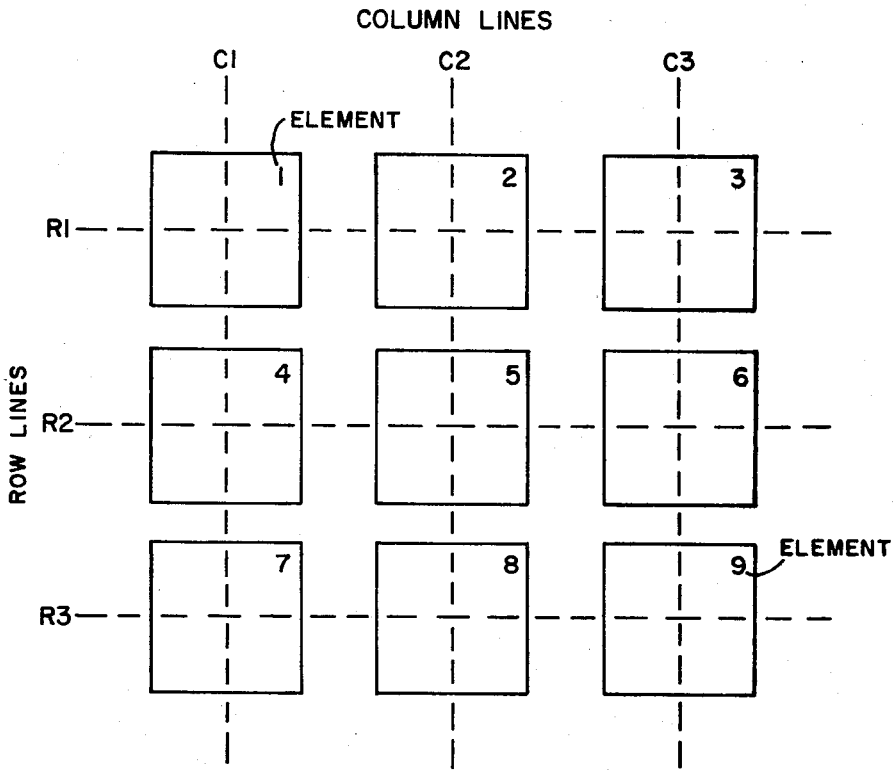
FIG. 2 is a 9 element phase shifter array with row and column command lines shown.
Figure 3A:
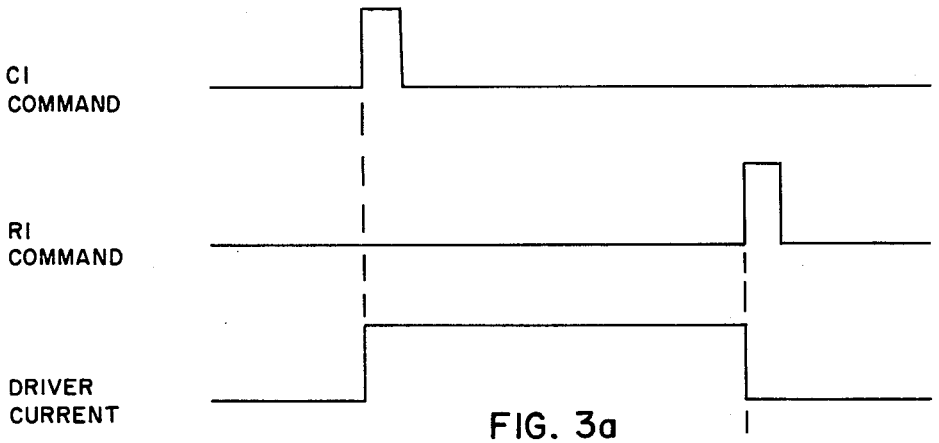
FIGS. 3(*a*) and 3(*b*) are command and current levels relationships for start/stop signals to phase shifter drivers.
Figure 3B:
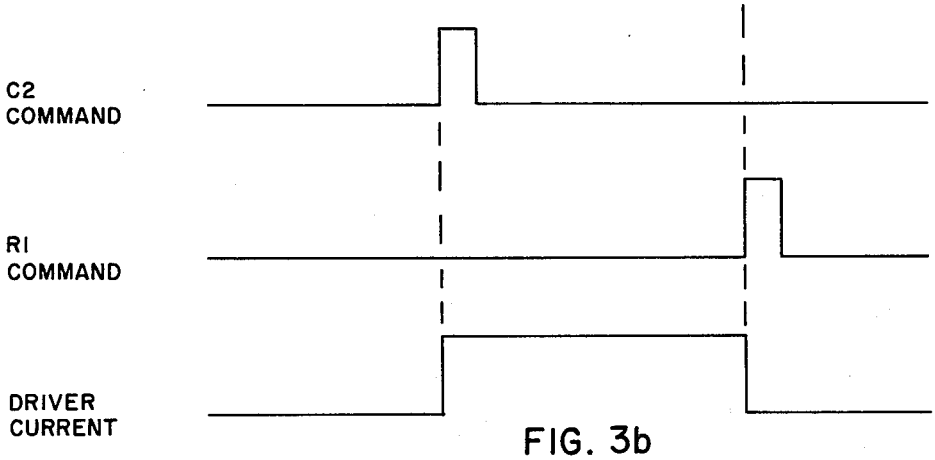
Figure 4A:
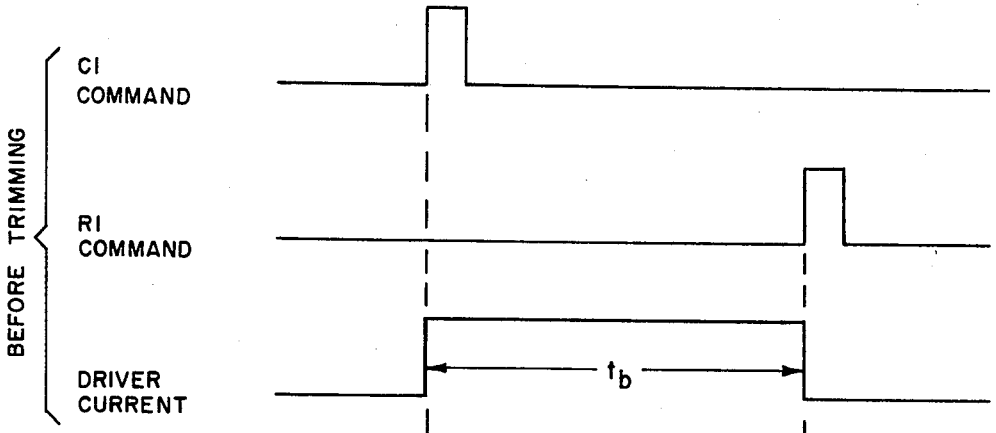
FIGS. 4(*a*) and 4(*b*) are timing sequence start/stop commands to the phase shifter and after insertion of a time delay.
Figure 4B:
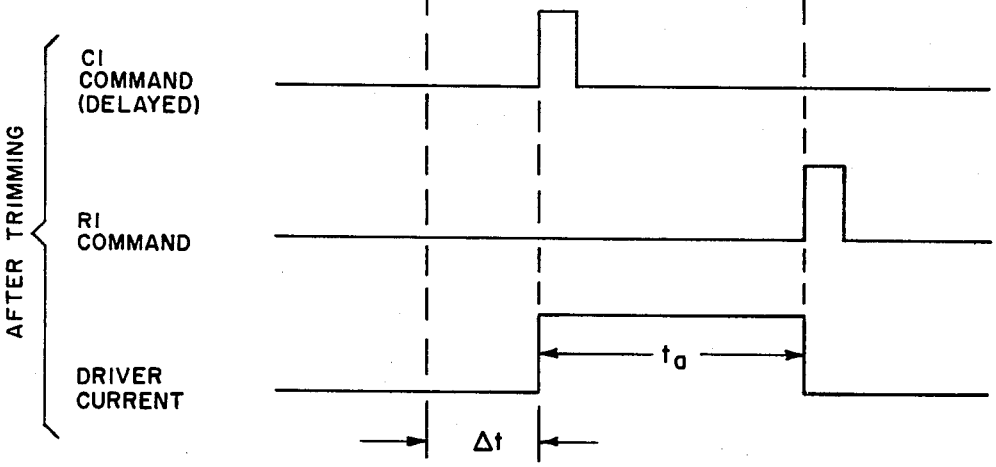

The phase shifter electronic trimming permits the beam steering computer to compute and send just the differential phase commands via the row and column lines, with the commands being modified by additional circuitry in the logic portion of the driver circuit. In accomplishing this, it is necessary to establish a reference phase length, k of Equation (3), to which all elements will be trimmed. Having established this reference point all differential phase commands to an element must be shortened by the difference between the actual elements insertion phase and the reference phase. In FIG. 4 it is assumed that the phasor of FIG. 1 has an insertion phase error, $\epsilon_I=k\ \Delta t$ longer than the reference phase. It is further assumed a total phase variation of $\Delta\phi_t=kt_b$ is required. Since phase is proportional to time as described in Equation (1), the abscissa of the graphs of FIG. 4 can be considered to be either time or phase. In actual practice they represent time, however, the result after interaction with the microwave portion of the phasor is phase setting. If the phase shifter were not trimmed the total phase variation would be the sum of the insertion and differential phase or $$\begin{aligned}\Delta\phi_t &= kt_b + \epsilon_I \\ &= kt_b + k\ \Delta t\end{aligned}$$

which is k Δt longer than desired. If, as shown in FIG. 4(*b*), the start pulse is delayed Δt the total phase variation is $$\Delta\phi_t=kt_a+\epsilon_I$$

since $t_a=t_b-\Delta t$, and $\epsilon_I=k\ \Delta t$ $$\Delta\phi_t=k\ (t_b-\Delta t)+k\ \Delta t$$

or $\Delta\phi_t=kt_b$ which is the desired phase described earlier. When the phase command is of very short duration or the insertion phase error is large it is possible that the start pulse may be delayed beyond the occurance of a stop pulse.

Figure 5:
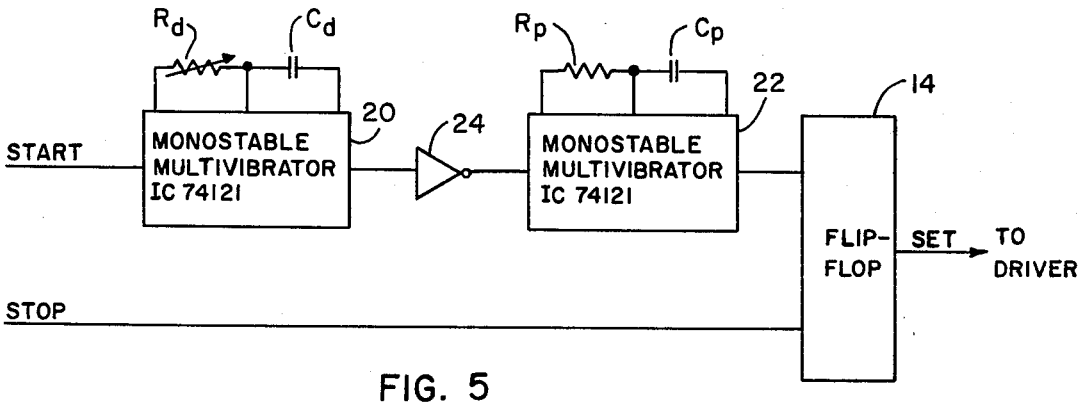
FIG. 5 is a block diagram of a preferred embodiment of the time delay and pulse forming network for providing trimming in the phase shifter.

Therefore, it is necesssary to send a second stop pulse to be sure that the driver is turned off. The two stop pulses are spaced in time, t, so that $$kT=360°$$

which is a full period of the wave. For example, assuming 1 second of driver "on" time results in a differential phase of 360°, and also assuming that the desired total phase variation is 30°, and the insertion phase error is 60°, an error could occur in the absence of a second stop pulse. Without the second pulse the delay circuit would delay the pulse 60/360=0.166 seconds, the stop pulse would occur at 30/360=0.0833 seconds or before the start pulse occurs. Therefore the driver would not turn off. However, with the second stop pulse present 1 second after the first stop pulse, the driver would be turned on from 0.166 seconds to 1.00833 seconds or for 0.916 seconds. This would result in a phase setting of $0.916\times360°=330°$. Since this particular device is 60° longer than the reference phase shifter the total phase variation is $330°+60°=390°$. Since the phase shift effects repeat every 360° the effective total phase variation is $390°-360°=30°$, which is the desired response. To provide this function it is necessary to modify the input circuit of the phase shifter driver to delay the start pulse an appropriate amount. As shown in FIG. 5 this change occurs in front of the flip-flop circuit, logic section 14 of FIG. 1. A time delay monostable multivibrator 20 associated with the phasor is shown with a pulse forming network 22 following multivibrator 20 to recreate the pulse. Resistor $R_d$ and capacitor $C_d$ are coupled to multivibrator 20 for controlling the time delay thereof. Similarly resistor $R_p$ and capacitor $C_p$ are coupled to network 22 for establishing the pulse width. Network 22 may also be a monostable multivibrator.

Figure 6:
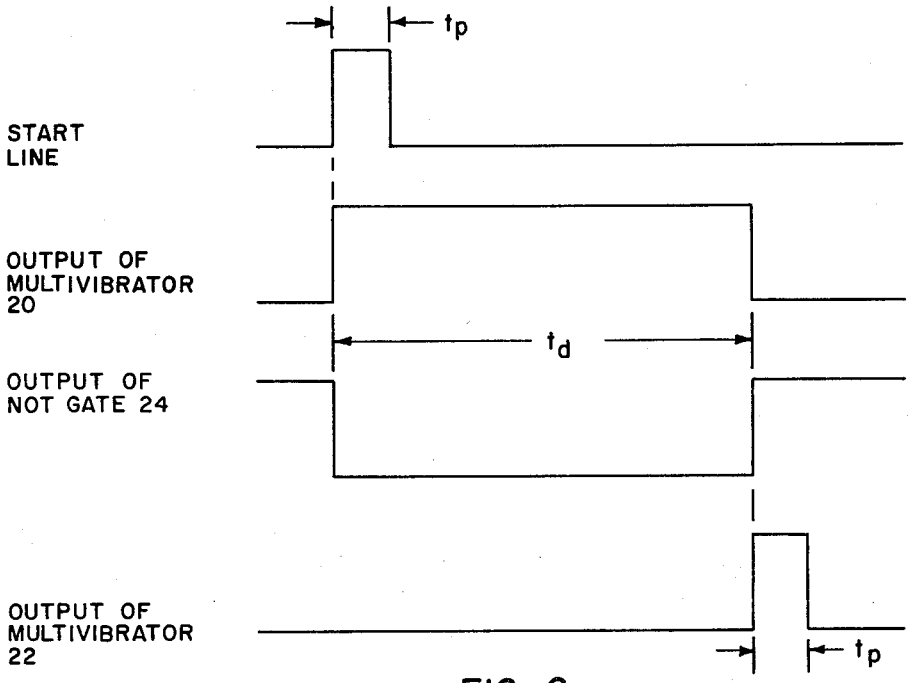
FIG. 6 is a timing sequence of outputs of the delay circuit of FIG. 5.

In operation the monostable multivibrator 20 associated with each phase shifter will take the first incoming pulse and produce an outut pulse of a duration depending on the value of $R_d$. At the conclusion of the pulse, the second multivibrator 22 is triggered "on" creating a pulse whose width is equal to the original input pulse. Only changes in $R_d$ or $C_d$ are used to alter the driver's operating time. $R_p$ and $C_p$ are not changed beyond initial setting of the network 22 operating cycle. The NOT gate 24 is placed in the circuit to invert the output of multivibrator 20 so that the second multivibrator will trigger on a leading positive going edge. Nominally, the pulse width for the circuit of FIG. 5 and the timing shown in FIG. 6 are given by $$t_p=0.7\ C_pR_p$$

$$t_d=0.7\ C_d,\ R_d,$$

where R is in ohms and C is in farads.

While the invention has been described in connection with a specific embodiment thereof, it should be understood that further modifications will suggest themselves to persons skilled in the art and it it intended to cover such modifications as may fall within the scope of the claims appended hereto.

I claim:

1. A phase shifter circuit for providing controllable time delay in phase shifter logic and comprising: a current driver for providing an output command signal to a load and adapted to receive an input control signal; a logic circuit having an output coupled as the input control signal for said driver, and having first and second inputs; and time delay means having an output coupled to said logic circuit first input, and having an input adapted for receiving an activating input signal; said time delay input and said logic circuit second input being adapted to receive respective start and stop input pulses for activating and deactivating said phase shifter circuit and thereby controlling the output command signal duration of said current driver; and said time delay means being a time delay and pulse forming network comprising first and second monostable multivibrators, each having an input and an output, the output of the first multivibrator being coupled to provide the input to the second multivibrator, the output of the second multivibrator being coupled as the first input to said logic circuit, and said first multivibrator input being the time delay means input.

2. A phase shifter circuit as set forth in claim 1 wherein said time delay means further comprises a NOT gate coupled between the output of said first multivibrator and the input of the second multivibrator.

3. A phase shifter circuit as set forth in claim 2 wherein said logic circuit comprises a flip-flop.

4. In a phased array antenna system having electronic beams steering and a plurality of phase shifters for providing said electronic beam steering and wherein two axis, start-stop, electronic commands are used for steering said phased array beams the method of controlling the phase shift of respective array antenna elements, comprising the steps of:

generating a start signal for activating steering command responses in a phase shifter;

delaying said start signal a predetermined time before phase shifter activation of said steering command responses;

generating a first stop signal for terminating steering command responses in said phase shifter;

directing a second stop signal 360 electrical degrees behind said first stop signal for assuring proper termination of said steering command response in said phase shifter.

* * * * *